US008678182B2

(12) United States Patent
Junk

(10) Patent No.: US 8,678,182 B2
(45) Date of Patent: Mar. 25, 2014

(54) CONTAINER FILLING DEVICE

(75) Inventor: Martin Junk, Tholey (DE)

(73) Assignee: HAMBA Fillitec GmbH & Co. KG, Saarbruecken (DE)

( * ) Notice: Subject to any disclaimer, the term of this patent is extended or adjusted under 35 U.S.C. 154(b) by 15 days.

(21) Appl. No.: 13/472,831

(22) Filed: May 16, 2012

(65) Prior Publication Data

US 2013/0126312 A1 May 23, 2013

(30) Foreign Application Priority Data

May 25, 2011 (DE) ..... 10 2011 103 152
May 25, 2011 (DE) ..... 10 2011 103 154

(51) Int. Cl.
*B65G 29/00* (2006.01)

(52) U.S. Cl.
USPC ..... 198/867.12; 198/803.14

(58) Field of Classification Search
USPC ..... 198/867.11, 867.12, 803.14, 803.15, 198/465.1, 465.2
See application file for complete search history.

(56) References Cited

U.S. PATENT DOCUMENTS 2,989,165 A * 6/1961 Cozart ..... 194/246
3,150,765 A * 9/1964 Ellis ..... 198/867.14
3,587,829 A * 6/1971 Sorensen ..... 198/867.12
3,622,043 A * 11/1971 Chotard ..... 198/465.1
4,359,149 A * 11/1982 Erlichman et al. ..... 198/465.2
4,368,037 A 1/1983 Limque et al.
5,178,257 A * 1/1993 Cross ..... 198/465.1
5,178,260 A * 1/1993 Hochbein ..... 198/867.15
6,170,634 B1 1/2001 Jaquet
7,918,334 B2 * 4/2011 Gaetano et al. ..... 198/867.12

FOREIGN PATENT DOCUMENTS

EP 0 995 700 A1 4/2000
EP 1 495 997 A1 1/2005
EP 1 636 097 B1 11/2006
WO WO 2005/005289 1/2005

* cited by examiner

*Primary Examiner* — James R Bidwell
(74) *Attorney, Agent, or Firm* — Von Rohrscheidt Patents

(57) ABSTRACT

A device for filling containers including an upper main element, a lower main element and lateral main elements connecting the upper and the lower main element; support elements arranged at one another without a continuous drive device, which support elements are provided with receivers for the containers and are run in an endless manner through the device past operating stations and along the main elements; a drive which runs the support elements in a feed direction at least through the upper main element or the lower main element along the operating stations; and operating elements arranged at the support elements through which a feed force of the drive is introduced into the support elements, wherein the operating elements at the support elements are gear racks in which a drive side feed member with a complementary teething engages in order to introduce the feed force into the support elements.

15 Claims, 4 Drawing Sheets

CONTAINER FILLING DEVICE

RELATED APPLICATIONS

This patent application claims priority from and incorporates by reference German patent application DE 10 2011 103 154.9 filed on May 25, 2011 and German patent application DE 10 2011 103 152.2 filed on May 25, 2011.

FIELD OF THE INVENTION

The present invention relates to a device for filling containers, in particular bottles or beakers, with food products, in particular liquid to paste-like dairy and fat products, juices, waters and similar, including an upper main element, a lower main element and lateral main elements connecting the upper element and the lower main element, a plurality of support elements arranged at one another without a continuous drive device, wherein the support elements are provided with receivers for the containers and are run in an endless manner through the device for filling the containers past operating stations and along the upper-, lower- and lateral main elements, including a drive which runs the support elements in feed direction at least through the upper main element or the lower main element along the operating stations, including operating elements arranged at the support elements, through which operating elements the feed force of the drive is introduced into the support elements.

BACKGROUND OF THE INVENTION

Filling devices are known in the art in which particular support elements are connected with a continuous drive chain through which they are run continuously through the filling device along the upper main element, the lower main element and the lateral main elements.

These filling devices have been in use for decades. A chain drive, however, has many disadvantages. One of the essential disadvantages is that a chain elongation during operation not only requires frequent readjustment but additionally requires separate positioning at each of the operating stations acting upon the containers.

For this reason and for other reasons, theoretical concepts have been developed for quite some time in which a chain drive device can be omitted.

Drives without chains for filling devices for food products have not really caught on in the marketplace, however, there are already a few functional systems that operate reliably.

A device of this type is known e.g. from EP 1 495 997 A1. In this document various concepts for implementing a chainless feed of support elements through a filling device for food products is described. They all have in common that the support elements with their respective faces arranged transversal to the feed direction and oriented towards one another are arranged at one another and are thus pushed through the filling device. The drive in EP 1 495 997 A1 can be provided e.g. through a piston operating in a linear manner and engaging recesses of the support elements. It is alternatively proposed to provide a drive wheel in a transition between the lower main element and the upper element wherein the drive wheel engages drive elements which are arranged below the support elements. Also a worm gear is illustrated in EP 1 495 997 A1.

In a chainless filling device for food products, the alternative drive concept has a particular significance. Filling devices of this type are operated at up to 60 cycles per minute which means that the support elements perform a feed movement in as little as one second. Consequently it is important to provide a controlled acceleration of the support elements, but also a controlled deceleration of the support elements through a respective drive concept. Thus, the configuration of the support element itself is important since the particular support elements do not enter an interconnection anymore that is caused through the drive device like e.g. a chain.

BRIEF SUMMARY OF THE INVENTION

It is an object of the invention to provide a support element for a device without a chain of the type recited supra wherein the support element can be accelerated and decelerated in a controlled manner.

The object of the invention is achieved through a device with the features of claim 1, thus a device for filling containers, in particular bottles or beakers, with food products, in particular liquid to paste-like dairy and fat products, juices, waters and similar, including an upper main element, a lower main element and lateral main elements connecting the upper element and the lower main element, a plurality of support elements arranged at one another without a continuous drive device, wherein the support elements are provided with receivers for the containers and are run in an endless manner through the device for filling the containers past operating stations and along the upper-, lower- and lateral main elements, including a drive which runs the support elements in feed direction at least through the upper main element or the lower main element along the operating stations, including operating elements arranged at the support elements, through which operating elements the feed force of the drive is introduced into the support elements.

The object is achieved in particular in particular with the features characterizing the support element, wherein the operating elements at the support element are gear racks in which a drive side feed member engages a complementary opposite teething in order to introduce the feed force into the support element.

A significant advantage of the support element with the gear rack is providing feeding without slippage between the drive and the support element. For the significant acceleration- and deceleration forces the form locking between the drive- and the support element provides controlled acceleration and deceleration.

Another essential advantage is achieved on the drive side. Herein a relatively small motor with a sprocket engaging the gear rack of the support element can be used, optionally with a transmission connected there between. The motor and the gear rack provide quick reaction. Relative to a linear piston described in EP 1495997 A1 the feed member of the drive does not have to perform any movement relative to the drive arrangement for the instant configuration of the support element.

Compared to a central drive sprocket arranged in a portion of the lateral main element the moving masses of the sprocket of the drive are much smaller, so that the drive can be configured smaller for reaching identical feed velocities and deceleration rates. With respect to installation size and moving masses the drive facilitated through providing the support element with a gear rack is also superior to the worm drive of EP 1 495 997 A1.

It is another advantage that the gear rack itself can be used as a stabilization- or stiffening element for a plate of the support element that is designated as a cell plate and provided with receivers for the container.

A particularly preferred embodiment provides that the support elements are run through the device on rollers, wherein the rollers contact running rails at the device. Rollers facilitate running the support element through the device with minimized friction.

In combination with this embodiment the gear rack is furthermore advantageous as an arrangement element for the rollers.

Since the gear rack is preferably arranged on the top side of the support element—the top side of the support element is also defined as the side oriented towards the operating stations—the support elements can include cutouts through which the rollers arranged at the gear rack reach at least partially and contact the running rail at the filling device.

Arranging the gear rack on a top side of the support element furthermore has the advantage that in case of rollers the running rails provided at the filling device, or the respective component on which the support element is pushed through the device, is also used as a support bearing for the drive. Consequently the gear rack is arranged between the drive and the contact element at the device for the support element so that the gear rack cannot slide under the drive even when high acceleration- and deceleration forces occur.

However, it is also conceivable that the support element is arranged on a frame.

It is also conceivable that at least two support elements are arranged on the frame behind one another in feed direction.

In the present case it is provided that the gear rack is arranged at the frame.

Alternatively it is conceivable that the gear rack is divided in two components and a gear rack component is directly arranged on each support element.

It is conceivable to provide an interconnected arrangement between the support elements, wherein adjacent support elements are interconnected through arrangement devices at the support element.

Thus, it is conceivable that the frame supporting the support element is provided with the arrangement device and that adjacent frames are joined through the arrangement devices to form an interconnection.

For exact positioning under the operating stations it is useful when the support elements are provided with a positioning aide.

Thus it can also be provided here that the positioning aide is directly arranged at the gear rack, in particular when the positioning aide is configured as a positioning pin.

In a particularly preferred embodiment it is provided that the gear rack on the surface of the support elements oriented towards the operating stations and the teeth of the gear rack are oriented away from the surface oriented towards the operating stations.

BRIEF DESCRIPTION OF THE DRAWINGS

Subsequently the advantages and features of the invention are described based on an advantageous embodiment with reference to drawing figures, wherein.

DETAILED DESCRIPTION OF THE INVENTION

Figure 1:
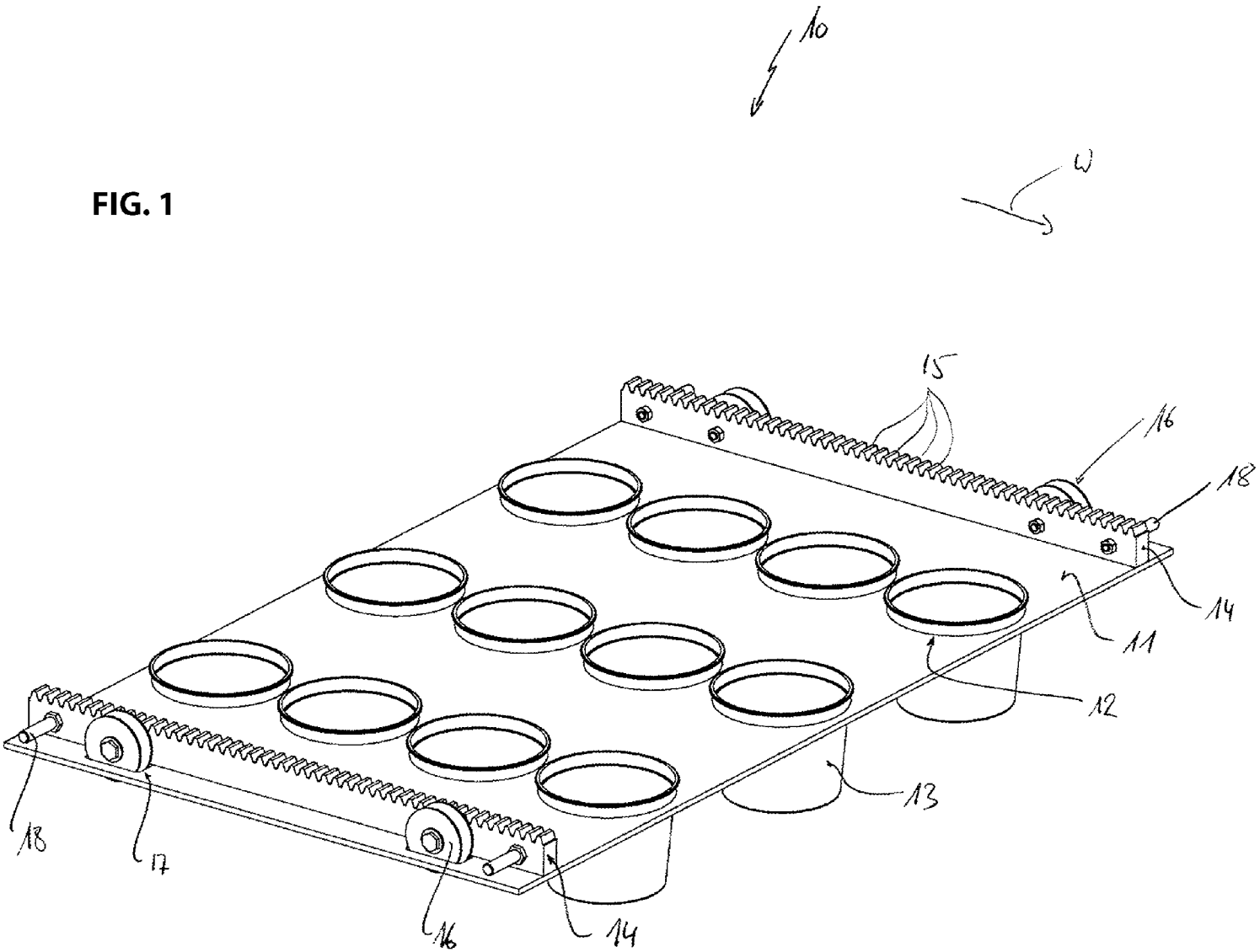
FIG. 1 illustrates an isometric view of a support element according to the invention from a top side.
Figure 2:
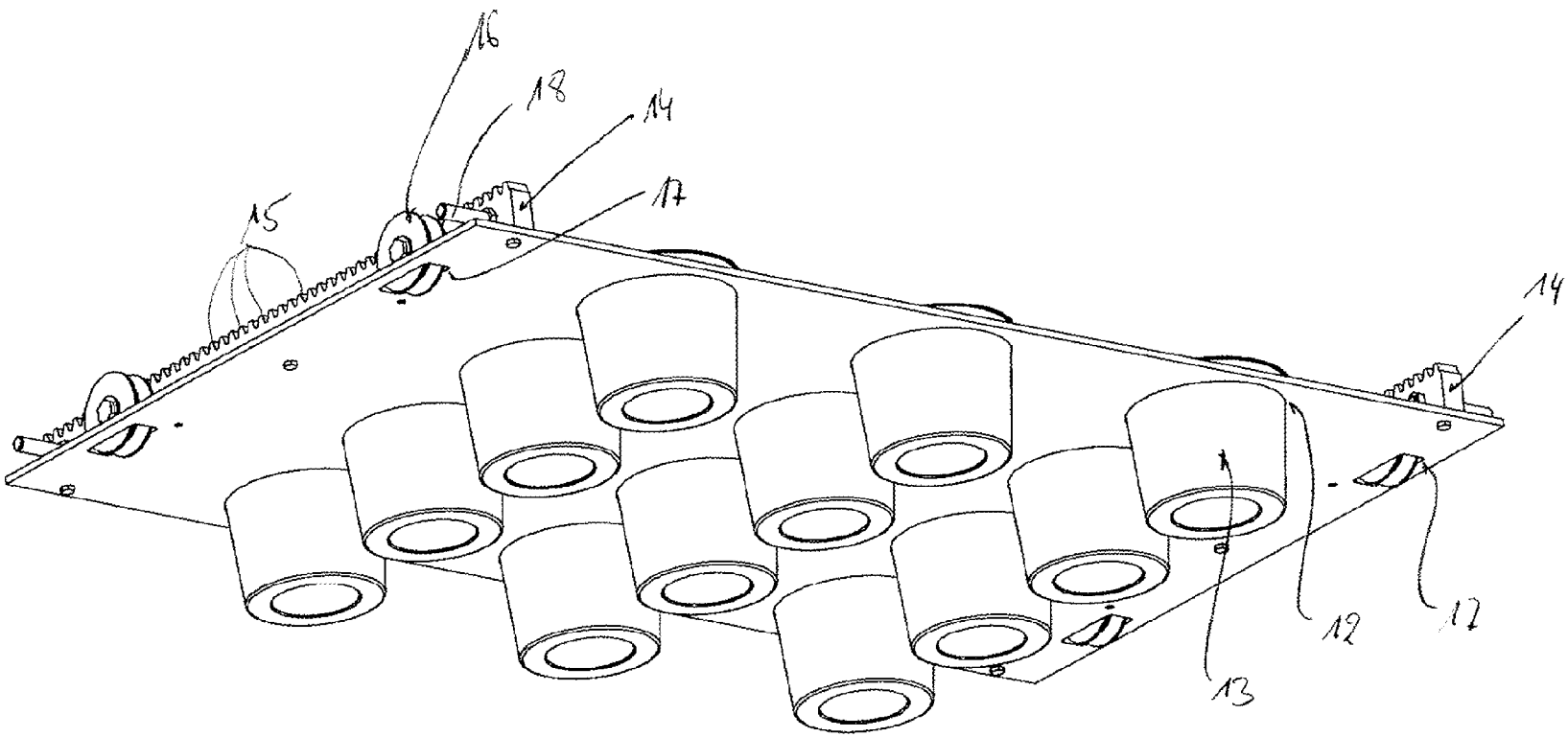
FIG. 2 illustrates the support element according to FIG. 1 in an isometric view of the bottom side.

In the figures, the support element for the device according to the invention is designated overall with the reference numeral 10.

The support element 10 includes a so called cell plate 11. The cell plate 11 is typically a rectangular plate which is provided with plural receivers 12 for containers 13. The receivers are introduced into the cell plate in series transversal to a feed direction W and in tracks in the feed direction W.

Figure 3:
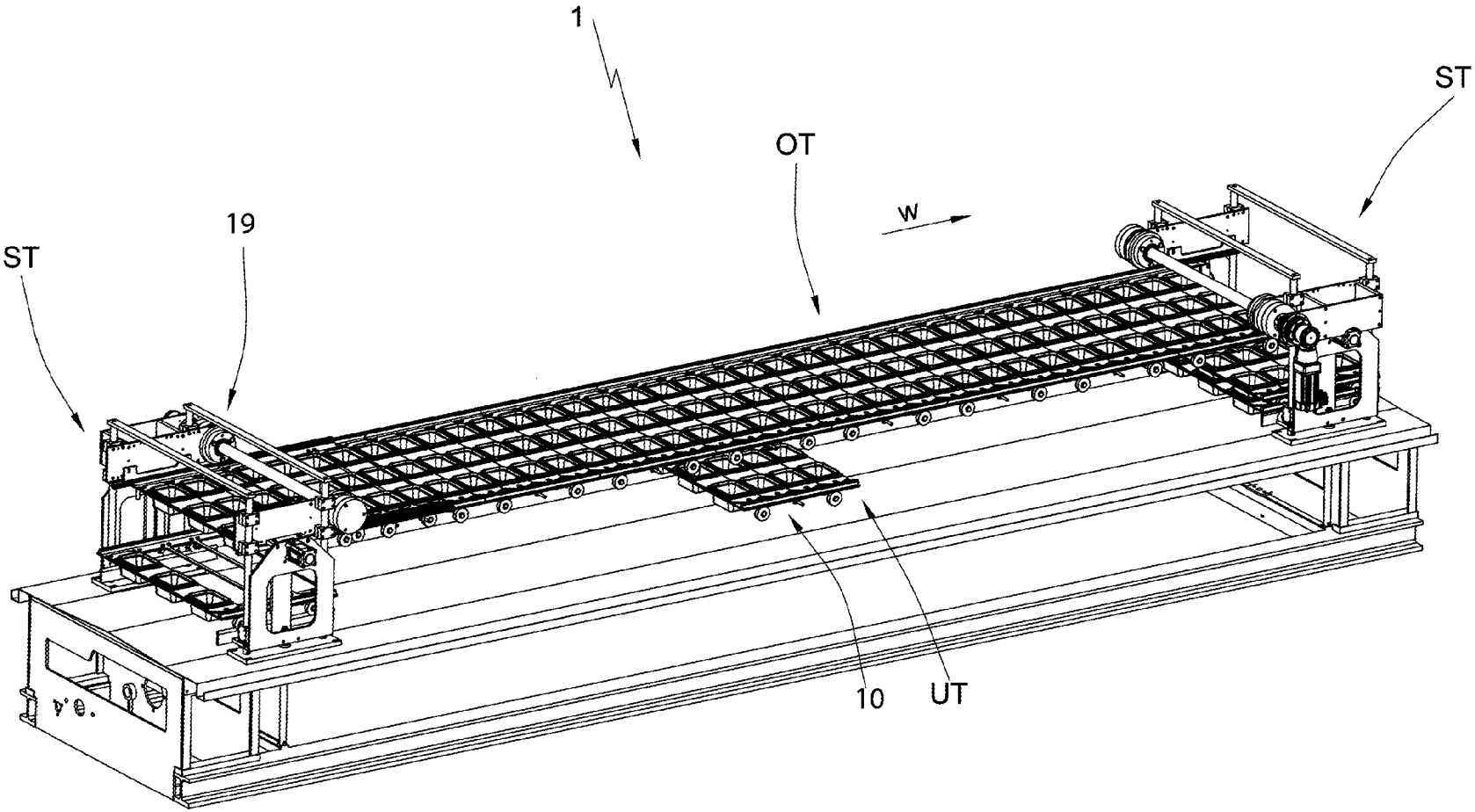
FIG. 3 illustrates a perspective view of the filling device.

FIG. 3 illustrates the filling device 1 with upper main element OT, lower main element UT, lateral elements ST and drive 19.

Figure 4:
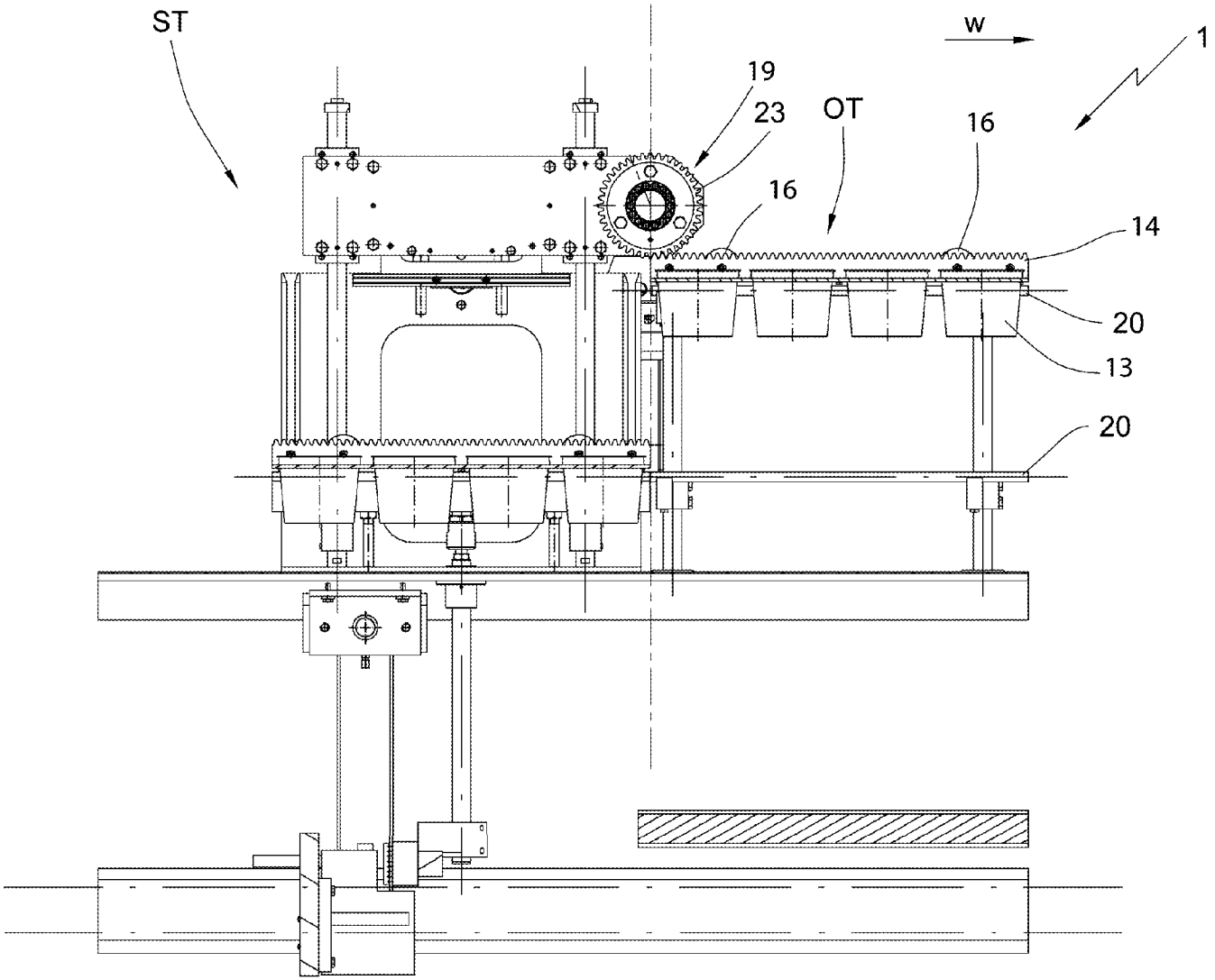
FIG. 4 illustrates a partial sectional view the filling device of FIG. 3.

FIG. 4 illustrates a gear 23 of the drive 19 engaging a gear rack 14 of a support element 10 running on running rails 20.

On a top side of the support element 10 oriented towards operating stations gears racks 14 are arranged which extend in feed direction W. Each gear rack 14 includes a plurality of teeth 15 which are oriented away from the top side of the cell plate 11.

The gear racks 14 support rollers 16 on which the support element 10 moves through the device. In order to facilitate a rolling of the rollers 16 on running rails 20 at the device, the illustrated cell plate 11 includes roller cut outs 17 through which the rollers 16 partially extend.

The gear racks 14 in the illustrated embodiment of the invention furthermore support positioning pins 18 which among other things can be used for aligning the support element 10 with respect to the operating stations of the device.

In the present embodiment the gears racks 14 have more functions than simply interacting with the drive. Besides the fact that the gear rack 14 arranged on the support elements 10 facilitates a very advantageous drive concept for the device according to the invention through a small motor and without large moving masses on the drive side, the gear rack 14 is also a stabilization and stiffening element for the cell plate 11. Furthermore the gear rack is a support element for many other components, in particular rollers 17 and positioning pins 18.

The form locking engagement of a drive side gear in the gear racks 14 of the support element 10 facilitates a controlled acceleration and in particular a controlled deceleration of the support element 10 when running through the device. This is particularly advantageous for acceleration- and deceleration torques associated with high cyclic rates.

REFERENCE NUMERALS AND DESIGNATIONS

1 device
10 support element
11 cell plate
12 receiver
13 container
14 gear rack
15 tooth
16 rollers
17 roller cutout
18 positioning pins
19 drive
20 running rail
23 gear
OT upper main element
UT lower main element
ST lateral element
W feed direction

What is claimed is:

1. A device for filling containers with food products, comprising:

an upper main element;

a lower main element;

lateral main elements connecting the upper and the lower main element;

a plurality of support elements arranged at one another without a continuous drive device, which support elements are provided with receivers for the containers and are moved in an endless manner through the device along the main elements;

a drive without a continuous drive device which moves the support elements in a feed direction at least through the upper main element or the lower main element; and operating elements arranged at the support elements through which operating elements a feed force of the drive is introduced into the support elements, wherein the operating elements at the support elements are gear racks in which a drive side feed member with a complementary teething engages in order to introduce the feed force into the support elements, wherein the support elements are moved at least through the upper main element and the lower main element by the drive side feed members which engage the gear racks.

2. The device according to claim 1, wherein the support elements are moved on rollers through the device, wherein the rollers contact running rails at the device.

3. The device according to claim 1, wherein the gear racks are respectively arranged directly on cell plates of the support elements.

4. A device for filling containers, comprising:

an upper main element;

a lower main element;

lateral main elements connecting the upper and the lower main element;

a plurality of support elements arranged at one another without a continuous drive device, which support elements are provided with receivers for the containers and are moved in an endless manner through the device along the main elements;

a drive which moves the support elements in a feed direction at least through the upper main element or the lower main element; and operating elements arranged at the support elements through which operating elements a feed force of the drive is introduced into the support elements, wherein the operating elements at the support elements are gear racks in which a drive side feed member with a complementary teething engages in order to introduce the feed force into the support elements, wherein the support elements are moved on rollers through the device, wherein the rollers contact running rails at the device, wherein the rollers are arranged directly at the gear racks.

5. The device according to claim 4, wherein the support elements include recesses through which the rollers arranged at the gear racks extend at least partially and contact the running rail at the device.

6. The device according to claim 1, wherein the support elements respectively include a frame on which a cell plate is arranged.

7. The device according to claim 6, wherein at least two cell plates are arranged in the feed direction behind one another on the frame.

8. The device according to claim 6, wherein the gear racks are arranged at the frame.

9. The device according to claim 7, wherein the gear racks are provided in two components and a gear rack component is arranged on each cell plate.

10. The device according to claim 1, wherein adjacent support elements are interconnected with one another through arrangement devices at the support elements.

11. The device according to claim 6, wherein the frames of the support elements are provided with the arrangement devices and adjacent frames enter an interconnection with one another through the arrangement devices.

12. The device according to claim 1, wherein the support elements are provided with a positioning aide.

13. The device according to claim 12, wherein the positioning aide is arranged directly at the gear rack.

14. The device according to claim 12, wherein the positioning aide is configured as a positioning pin.

15. The device according to claim 1, wherein the gear rack is arranged on the surface of the support elements oriented upward and the teeth of the gear rack are oriented away from the surface of the support elements oriented upward.

* * * * *

UNITED STATES PATENT AND TRADEMARK OFFICE

CERTIFICATE OF CORRECTION

PATENT NO. : 8,678,182 B2
APPLICATION NO. : 13/472831
DATED : March 25, 2014
INVENTOR(S) : Martin Junk It is certified that error appears in the above-identified patent and that said Letters Patent is hereby corrected as shown below:

On the Title Page:

Item (73), Assignee Name, should read: HAMBA Filltec GmbH & Co. KG

Signed and Sealed this
Seventeenth Day of June, 2014

Michelle K. Lee

Michelle K. Lee
*Deputy Director of the United States Patent and Trademark Office*